US007088932B2

(12) United States Patent
Chou et al.

(10) Patent No.: US 7,088,932 B2
(45) Date of Patent: Aug. 8, 2006

(54) SYSTEM AND METHOD FOR MEASURING CHARGE/MASS AND LIQUID TONER CONDUCTIVTY CONTEMPORANEOUSLY

(75) Inventors: Hsin Hsin Chou, Woodbury, MN (US); William D. Edwards, New Richmond, WI (US); Robert E. Brenner, New Richmond, WI (US); Andrew J. McClaren, Blaine, MN (US)

(73) Assignee: Samsung Electronics Co., Ltd, Suwon (KR)

( * ) Notice: Subject to any disclaimer, the term of this patent is extended or adjusted under 35 U.S.C. 154(b) by 100 days.

(21) Appl. No.: 10/749,868

(22) Filed: Dec. 31, 2003

(65) Prior Publication Data

US 2005/0141910 A1 Jun. 30, 2005

(51) Int. Cl.
*G03G 15/10* (2006.01)

(52) U.S. Cl. ..... 399/57

(58) Field of Classification Search ..... 399/57, 399/237

See application file for complete search history.

(56) References Cited

U.S. PATENT DOCUMENTS 4,577,948 A 3/1986 Lawson et al. ..... 396/571
4,860,924 A * 8/1989 Simms et al. ..... 399/57
5,447,056 A * 9/1995 Foote ..... 399/57
5,689,779 A * 11/1997 Miyamoto et al. ..... 399/237
5,848,322 A * 12/1998 Chen et al. ..... 399/57
5,970,289 A * 10/1999 Yoo ..... 399/237
6,131,001 A * 10/2000 Tsukamoto et al. ..... 399/57
6,154,620 A 11/2000 Hagiwara ..... 399/57
6,256,460 B1 * 7/2001 Nozawa et al. ..... 399/57
6,278,850 B1 * 8/2001 Park ..... 399/57
6,330,406 B1 12/2001 Yamaguchi ..... 399/58
6,535,700 B1 3/2003 Caruthers ..... 399/57
6,819,888 B1 * 11/2004 Teraoka et al. ..... 399/57

FOREIGN PATENT DOCUMENTS

JP 11264812 9/1999

* cited by examiner

*Primary Examiner*—Susan Lee
(74) *Attorney, Agent, or Firm*—Mark A. Litman & Associates, P.A.

(57) ABSTRACT

A method measures the conductivity (σ) of a liquid or paste electrophotographic toner by providing two parallel plane conductive plates with a uniform separation (d) between the plates to form a space between the plates; filling the space between the plates with liquid or paste electrophotographic toner; applying an alternating current voltage of at least 100V between the plates across the liquid or paste toner; measuring as data the current passing through an external component into the plates; adjusting the data to remove current contributions attributable to impurity ions; sending adjusted data to a processor; and determining the conductivity from the adjusted data.

15 Claims, 6 Drawing Sheets

SYSTEM AND METHOD FOR MEASURING CHARGE/MASS AND LIQUID TONER CONDUCTIVTY CONTEMPORANEOUSLY

BACKGROUND OF THE INVENTION

1. Field of the Invention

The present invention relates to the field of electrophotgraphy, particularly liquid toned electrophtotoconductive imaging, and to a novel method of determining the charge per mass and liquid toner conductivity values contemporaneously for liquid toner in production.

2. Background of the Art

Electrophotography forms the technical basis for various well-known imaging processes, including photocopying and some forms of laser printing. Electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

Electrophotographic imaging is an established technology in a wide variety of imaging environments, not the least of which is desktop printing in black-and-white and full color. The technology advantageously uses liquid toner materials (also referred to as inks) in the production of high quality images. These liquid toners must be developed first on a lab scale and then be scaled up to mass production. Current liquid electrophotographic toner development processes require that multiple accurate measurements be taken for each new liquid toner formulation. Currently each test must be performed separately. Additionally, there are often impurities in the liquid toner that contribute to false or inaccurate analytical readings. The electrophysical nature of the electrophotographic process is itself well understood, as follows.

The prior art developing apparatus which is shown in FIG. 1 comprises a vessel 1 for a supply of dielectric fluid 2. The fluid 2, in turn, contains a dispersion of positively and negatively charged toner particles 3.

The vessel 1 further contains two spaced-apart electrodes 4 and 5 which dip into the supply of fluid 2. The electrode 4 is provided with at least one but preferably two or more suitable clamping elements 6 and 7 which can removably receive and hold a sheet-like carrier 8 of latent electrostatic images. For example, the sheet 8 which is shown in FIG. 1 can be inserted from above so that its lower edge rests on the clamp 7 and each of its lateral marginal portions is partially held by a discrete clamp 6. The latent image on the sheet 8 in the vessel 1 faces the electrode 5.

The electrode 4 is connected with a measuring resistor R1 by conductors 9 and 11. The other electrode 5 is connected with the resistor RI by a conductor 10. A further conductor 12 connects the conductors 9, 11 with the ground.

The toner particles 3 which are dispersed in the dielectric fluid 2 include negatively as well as positively charged particles, particularly at the start of a developing operation.

The image bearing portions of the sheet 8 are negatively charged, and such negative charges are compensated for by positive charges on the adjacent portions of the electrode 4. The just mentioned positive charges on the electrode 4 are mirror images of negative (image) charges on the sheet 8. In the course of electrophoretic development, the negative image on the sheet 8 attracts positive toner particles 3 from the fluid 2, i.e., such positively charged toner particles 3 travel toward the adjacent surface of the clamped sheet 8 whereby the positive charges of the thus attracted particles 3 are neutralized by the negative charges on the image bearing portions of the sheet 8. The mirror symmetrical positive charges of the electrode 4 are thereby free to travel toward the electrode 5 to attract the negatively charged toner particles 3 in the fluid 2 and to cause them to advance in the fluid 2 toward and onto the electrode 5. These negatively charged toner particles 3 are neutralized when they reach the electrode 5.

It will be noted that, in the course of electrophoretic development process, there develops a current which flows between the electrodes 4, 5 and causes a voltage drop at the measuring resistor R1. The current flows until the entire electrostatic latent image on the sheet 8 is discharged as a result of deposition of toner particles 3 thereon. As shown in FIG. 2, a relatively high current $i'_0$ develops in immediate response to insertion of a fresh electrostatically charged sheet 8 into the vessel 1, and such current rapidly decreases to a value $i_0$ during the initial interval of time subsequent to insertion of a fresh sheet 8. The decrease of current from $i_0$ to $i_1$ is more gradual during the next-following interval of time ($t_1$). The current $i_1$ which flows after elapse of the interval $T_1$ can be fairly approximately defined as follows:

$$i(t)=i_0 \ldots e^{-t/96}.$$

The relationship with the neutralized charge on the sheet 8 can be established by ascertaining the area below the curve I of FIG. 2. The amount of charge (Q) can be ascertained by integration of the current function as follows:

$$Q=\text{integral}[i_0 \ldots e^{-t/\tau} \ldots dt]$$

The extent to which the latent image on the sheet 8 is developed corresponds to the ratio of the area A (between the curve I and the abscissa and ordinate of FIG. 2) and the area $A_1$ (which is bounded by the ordinate, abscissa up to the point $t_1$, and the curve I). The area A is indicated by simple hatching, and the area $A_1$ is indicated by criss-cross hatching. The areas A and $A_1$ can be calculated by standard mathematic means. The ratio of the areas $A_1/A$ (i.e., the intensity or extent of development of the sheet 8) can be ascertained as is well understood in the art (e.g., U.S. Pat. No. 4,257,347).

As regards the ascertainable ratio of the momentary value $i_1$ of the current flowing between the electrodes 4, 5 and the initial value $i_0$ of such current, there exists the following relationship:

$$i_1/i_0=1-A_1/A=1-\text{extent or degree of development.}$$

The curve I of FIG. 2 further shows that the actually achieved peak voltage at the start of the development closely approximates that which corresponds to the theoretically possible peak current value $i'_0$ if one insures that, at the start of the developing operation, the developing fluid is supplied to the exposed surface of the sheet 8 as rapidly as possible and in the form of a laminar stream. For example, this can be achieved by resorting to a dipping device for the sheet 8 or by resorting to a fluid recirculating arrangement, e.g., an arrangement of the type shown in FIG. 1. The preceding equations are valid provided that, based on a uniform rinsing speed at the start of the developing operation, the ratio $i'_0/i_0$ remains at least substantially constant. That is, the toner density stays approximately the same and the voltage drops due to toner build up and current flow through the resistor is small.

FIG. 1 shows that, in order to ascertain the momentary value of the current which flows between the electrodes 4, 5 in the course of the electrophoretic developing operation, as well as to interrupt the developing operation when the desired degree or extent of development is reached, one can resort to the following circuit:

The conductor 10 which connects the electrode 5 with the measuring resistor R1 is further connected with the input of an amplifier $V_1$ by means of a further conductor 13. The purpose of the amplifier $V_1$ is to change the voltage (corresponding to current which is represented by the curve I of FIG. 2) to a voltage having a different (higher) amplitude. The two voltages are schematically shown to the left and above and to the right and below the amplifier $V_1$ The amplitude-modified voltage is transmitted to one input of a comparator circuit K via conductor 14, and to a peak value storing circuit Sp via conductor 15. The circuit Sp stores the maximum voltage value (i.e., the initially transmitted voltage impulse), and its output transmits a constant voltage signal (schematically shown to the right of the circuit Sp) having an amplitude which corresponds to the peak value.

The voltage signal at the output of the circuit Sp is transmitted to an adjustable multiplying circuit $V_2$, $R_2$ and the intensity of such signal is reduced (as shown to the left of the component $R_2$) to an extent corresponding to the desired degree of development of the sheet 8. The voltage signal (reference signal) of reduced intensity is transmitted to the left-hand input of the comparator circuit K via conductor 16. The conductors 17, 18 connect the output of the circuit Sp with the components $V_2$, $R_2$ of the multiplying circuit, and the conductor 19 connects the outputs of the components $V_2$, $R_2$.

The circuit K compares the momentary value (transmitted via conductor means 14) of the voltage at the resistor $R_1$ with the somewhat reduced peak value (i.e., with the reference value) which is transmitted via conductor 16. Since the voltage at the resistor $R_1$ is proportional to the current which flows between the electrodes 4 and 5, a relay S is energized at the exact moment when a certain preselected current $i_1$ flows between the electrodes 4 and 5. The relay S is respectively connected to the ground (via conductor 12) and to the comparator circuit K by conductors 21 and 20. The energized relay S actuates a switch 22 at the time t.sub.1 so that the conductor 23 for the switch 22 can transmit a signal which starts the reversible motor 24M of a pump 24 in a first direction. The pump 24 then rapidly causes the fluid 2 to flow from the vessel 1 into a reservoir 27 and to thus complete the developing operation. The motor 24M is preferably a tandem motor, and it causes the pump 24 to convey the fluid 2 in the opposite direction (from the reservoir 27 into the vessel 1) when the switch 22 opens and the relay S closes a switch 29 in a conductor 31 connecting the relay S with the motor 24M. The reference characters 25, 26 respectively denote the conduits which connect the pump 24 with the vessel 1 and reservoir 27. The velocity with which the pump 24 can transfer the fluid 2 from the vessel 1 into the reservoir 27 is preferably sufficiently high so that the development of latent image on a sheet 8 which is clamped to the electrode 4 is terminated almost instantaneously, i.e., after elapse of the interval t.sub.1 following the start (t $V_0$) of the developing operation.

The interval $t_1$ determines the discussed ratio $A_1/A$ and hence the degree of development of the image on the sheet 8 in the vessel 1. To start the development of image on the next sheet 8, the relay S actuates a switch 28 which is mechanically or otherwise coupled to the aforementioned switch 29. The latter causes the conductor 31 to transmit a signal which starts the motor 24M in reverse, i.e., the fluid 2 is pumped from the reservoir 27 into the vessel 1. The switch 28 is connected with the relay S by a conductor 30 which forms part of the holding circuit of the relay. Such holding circuit is broken when the motor 24M is operated in reverse. The inflow of fluid into the vessel 1 is preferably rapid so that the development of image on the freshly introduced sheet 8 can begin practically instantaneously.

Because the electrophotographic toning process is so critically dependent in liquid toner electrophoresis and transfer, the ambient and varying properties of the liquid toner become very important, as well as the mere physical volume of toner remaining in the supply container. Processes and apparatus have therefore been developed to alert the user automatically when the properties and/or volume of the toner fail to meet requirements.

U.S. Pat. No. 4,577,948 (Lawson et al.) describes how changes occurring in the electrical conductivity of liquids are used to process image-wise exposed radiation-sensitive devices to measure the deterioration in effectiveness of the liquids. This deterioration is compensated for by varying the processing conditions, such as temperature, time, scrubbing action and processing liquid composition, in accordance with the change in conductivity. The reference uses an apparatus for processing image-wise exposed radiation sensitive plates which apparatus comprising (i) a container for processing liquid, (ii) a means of moving the plates along a path through the apparatus so that they are contacted by the processing liquid under given processing conditions, (iii) a means for measuring the electrical conductivity of the processing liquid and for producing an output signal in dependence on said conductivity, and (iv) a means of varying the processing conditions in dependence on said output signal, wherein said means of varying the processing conditions includes a variable speed motor for driving the plate moving means and controlled by said output signal so that the period of time for which the plates are in contact with the processing liquid is dependent on the conductivity.

Commonly assigned U.S. patent application Ser. No. 10/285,385, filed Oct. 31, 2002 (and which is herein incorporated by reference for its complete technical disclosure) describes a method for determining the concentration of toner solids present or remaining in any quantity of liquid solvent. One embodiment of the invention involves a series of steps. An electrical signal generator is electrically connected to a first electrode. A second electrode, attached or electrically connected to a detecting device, is positioned at a prescribed gap distance (e.g., between 0.005 inches and 0.250 inches) from the first electrode. The two electrodes are submerged in a liquid printing ink (in the practice of the invention in an electrophotographic imaging system, within the toner cartridge), maintaining the prescribed gap distance from one another. The signal generator then transmits an alternating current electrical signal (AC signal) or a direct current signal (DC signal) having a known amplitude to the first electrode. The direct current signal may be pulsed, and the receiving/signaling system may respond to the lack of pulses over a period of time to indicate depleted toner. The second electrode then receives any residual signal that is transmitted or propagates across the prescribed gap distance. The amplitude of the received signal is either detected at an acceptable intensity or determined to be absent or below the acceptable level, and a warning is generating based on whether the signal is received at the acceptable level or not received at an acceptable level (the unacceptable level including no signal received). Additionally, decisions may be made based on the amplitude of the received signal.

U.S. Pat. No. 6,154,620 (Hagiwara) describes a toner concentration measuring method and apparatus by which the concentration of toner in solvent can be detected with a simple construction without being influenced by a variation of the conductivity caused by a variation of the amount of ions in the solvent. A stepped dc voltage is applied from a high dc voltage generation section between a pair of electrodes placed in solvent, and very weak current which flows in a circuit formed from the pair of electrodes is measured by a current measuring section. The solvent between the pair of electrodes is replaced into an equivalent circuit, and a capacitance of the equivalent circuit is calculated in accordance with a circuit equation to determine the amount of ions in the solvent. Further, in accordance with a function expression wherein the ion amount and a resistance of the equivalent circuit are used as parameters, a toner concentration from which an influence of a variation of the amount of ions in the solvent is eliminated is determined.

U.S. Pat. No. 6,330,406 (Yamaguchi) describes a toner concentration detecting apparatus, which can detect a toner concentration of a developer without being influenced by ions, is provided. A first electrode and a second electrode are disposed face to face with a developer between the electrodes. First, a voltage of a first power supply is applied to the electrodes. After a designated time, by switching means, a voltage of a second power supply, whose polarity is different from the first power supply, is applied to the electrodes. By using a changing of current flowing between the electrodes caused by the difference between the transferring speed of toner particles and that of ions after switching the polarity of the power supply, a toner concentration calculating means calculates the toner concentration of the developer by using a table showing the relation between a peak value by the toner particles and the toner concentration. With this, the toner concentration can be calculated accurately. The toner concentration detecting apparatus, comprises: a first electrode and a second electrode which are disposed face to face with a developer between said electrodes; two power supplies, either one of which applies a voltage to said first electrode and said second electrode at one time; a switching means which switches polarity of said power supplies by switching from one power supply to the other power supply, after one power supply applied a voltage to said first electrode and said second electrode for a designated time; a detecting means which detects current flowing between said first electrode and said second electrode, at the time after applying voltage to said first electrode and said second electrode and after switching the polarity of said power supplies; and a calculating mean s which calculates a toner concentration of said developer, based on detected current values due to both ion and toner particles.

U.S. Pat. No. 6,535,700 (Caruthers) describes a toner developability sensor and method sense toner developability of liquid ink in an ink reservoir of a liquid ink image forming system. The toner developability sensor includes a power supply, a first electrode having at least one surface in contact with the liquid ink and connected to the power supply, and a second electrode spaced from the first electrode. When a potential difference is applied between the first and second electrodes, a developed toner layer is formed on the first electrode. A sensor senses at least one characteristic of the developed toner layer formed on the first electrode. The sensor detects characteristics of the developed toner layer that are directly related to the developability of the toner. The toner developability sensor that measures toner developability of a liquid ink contained in an ink tank, the liquid ink comprising toner particles suspended in a carrier medium, comprises: a power supply; a first electrode having at least one surface in fixed contact with the liquid ink in the ink tank and connected to the power supply; a second electrode disposed in the ink tank and having at least one surface in contact with the liquid ink and spaced from the first electrode, wherein, when a potential difference is applied between the first and second electrodes, a developed toner layer is formed on the first electrode; and a sensor that senses at least one characteristic of the developed toner layer formed on the at least one surface of the first electrode.

Alternative efficient methods of determination of operational parameters that are important for gauging the life and performance quality of liquid toner reserves are still desirable. This system may be used independently of imaging apparatus as an off-line testing system.

SUMMARY OF THE INVENTION

A device and process are used for quality control of liquid toner supplies to provide printing consistency. Toner conductivity and charge per mass (Q/m) are measured by a simple and reliable device operated in conjunction with software executed by a processor. The process generally comprises passing a liquid toner through an opening between plates acting as electrodes, providing a current between the plates, measuring output as a function of time (preferably through a digitizing circuit), and analyzing the data to extract toner conductivity values. This may be performed in real time or the data stored and the data subsequently evaluated. The method of the invention enables a user to determine both Q/M and conductivity simultaneously, and to do so with apparatus of minimum expense in addition to components that are ordinarily present in sophisticated electrophotographic environments.

DETAILED DESCRIPTION OF THE INVENTION

A device for assisting in the determination of toner quality and properties, especially liquid toner conductivity and the charge/mass (Q/m) in the liquid toner, consists of two parallel plates with a fixed separation distance between them, a power supply, a trigger switch, signal retrieving capability, digitizing circuitry and a processor for storage and reading/analyzing/interpreting/derivation of signal data. Liquid toner passes between the plates or is injected into a non-flowing condition (stable, without macro-mass flow currents) and voltage is established between the plates. The electrical output is measured as a function of time, preferably through a digitizing circuit, and the data is processed to extract values of toner conductivity and the charge/mass (Q/m) is determined.

Figure 3:
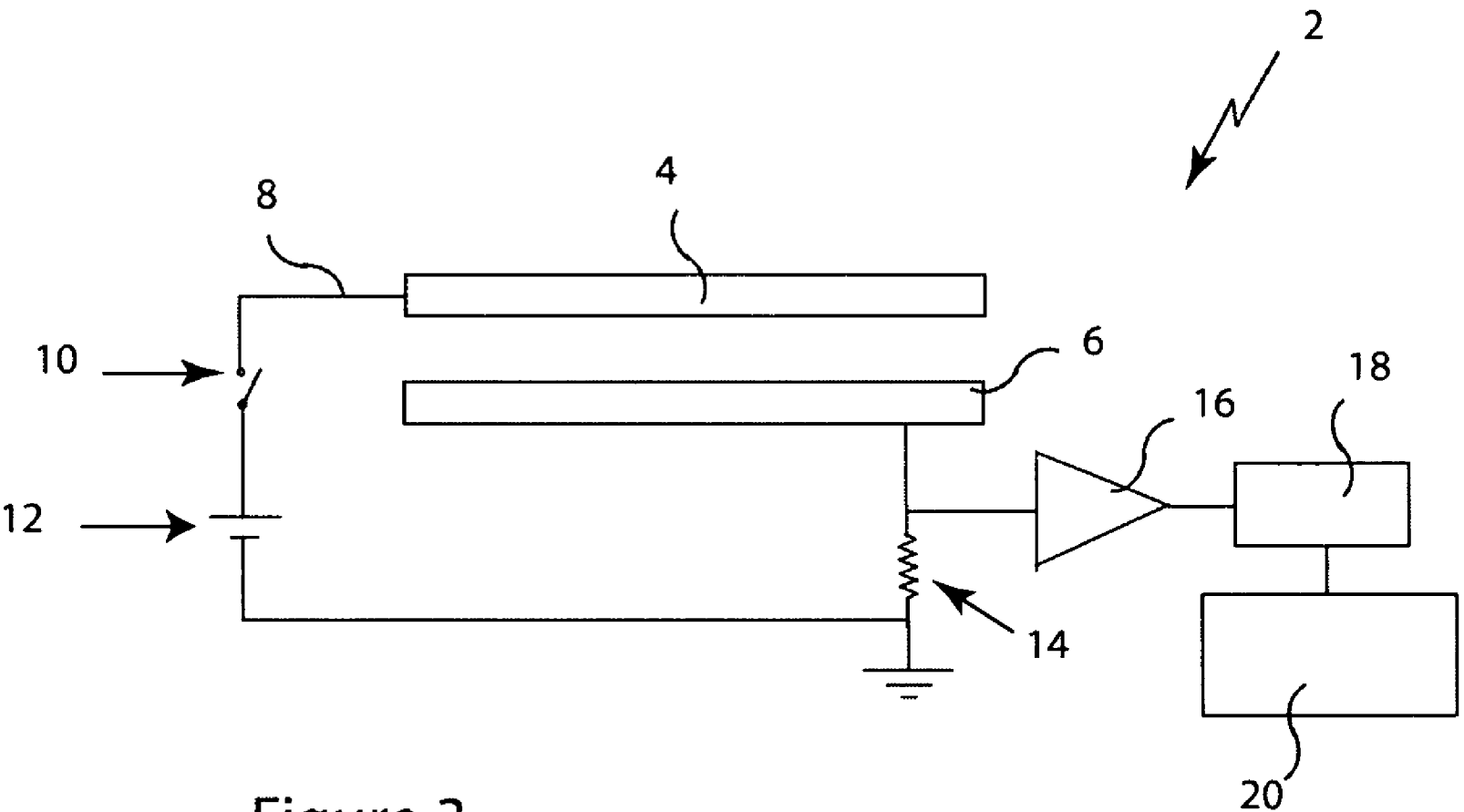
FIG. 3 shows a schematic of a transient cell for toner conductivity measurement.

FIG. 3 shows a schematic of a transient cell system 2 for measurement of toner conductivity. The system 2 comprises two parallel plates 4, 6 (e.g., conductive plates, such as metal plates, preferably metal plates that are not oxidized by liquid toner, such as polished aluminum plates), conductive line 8, a switch (preferably a high speed switch, such as a bounceless high speed switch (or counter switch) as described in U.S. Pat. Nos. 5,844,185, 5,315,471, 4,315,238), power supply 12, current sensor 14, noise reduction filter (e.g., The filter in the circuit is for removing very high frequency noise that the oscilloscope/digitizer we used was apparently sensitive to. The actual filter cutoff frequency was about 10 kHz (−3 db point)) 16, a digitizer 18 (which may be incorporated in the subsequent processor or computer), for data storage and analytic capability 20 (e.g., a processor or computer). The terminology of "High speed" is used to represent a time that is very short as compared to the measurement time. This switching time should be less than 1–2 milliseconds, a preferred switch would be a semiconductor switch that switches in less than 10 microseconds. Semiconductor switching can be bounceless, meaning that when it switches it remains either closed or open as opposed to "chattering" as it closes (several on-off cycles in a very short time)

Figure 1:
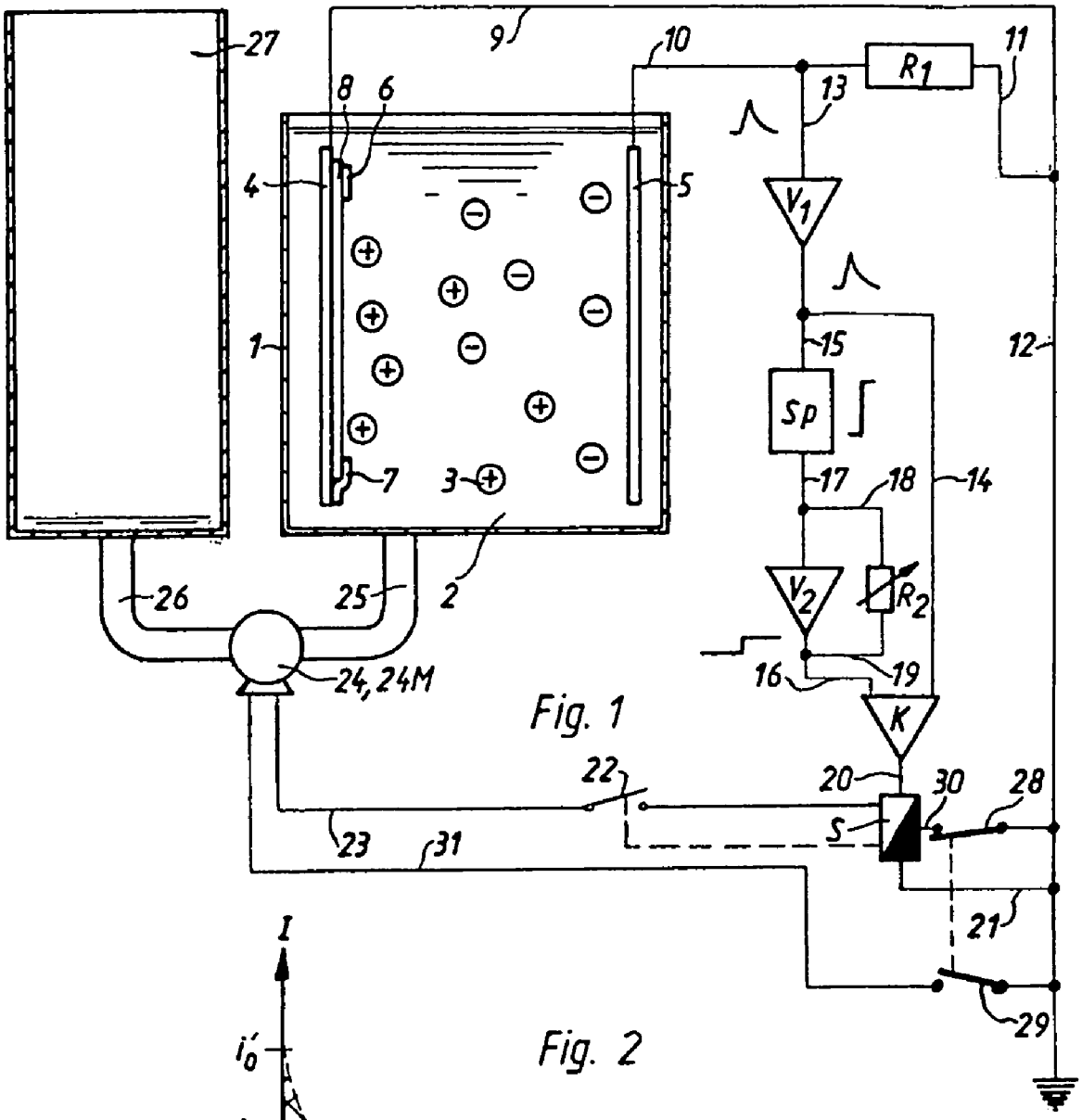
FIG. 1 shows a prior art electrostatic image transfer system.
Figure 2:
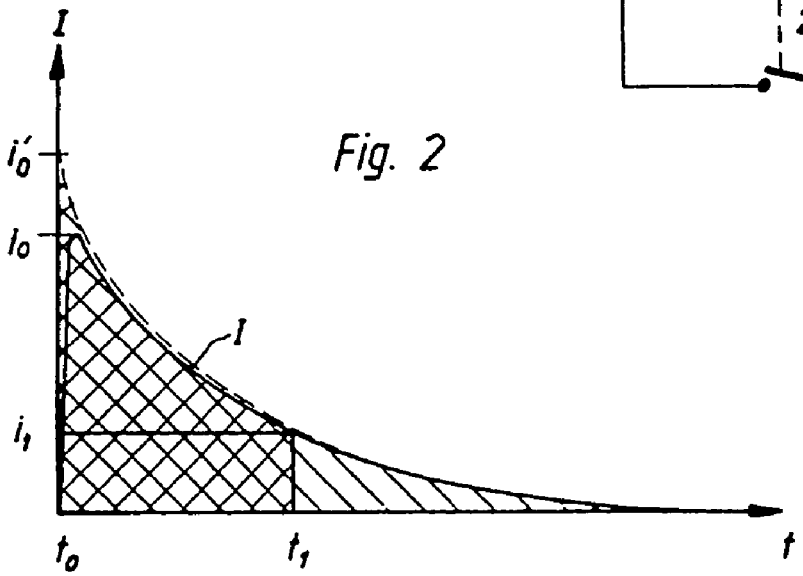
FIG. 2 shows a graph of current versus time in the system of FIG. 1.
Figure 4:
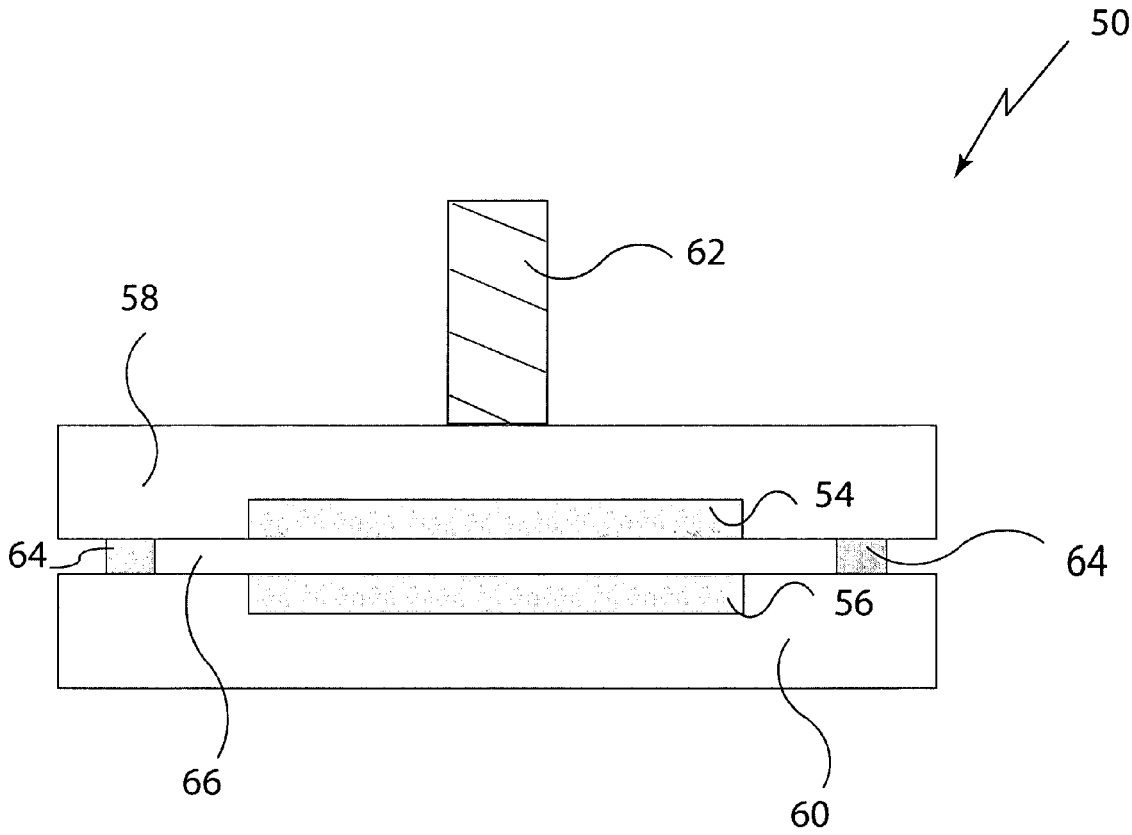
FIG. 4 shows a more detailed schematic of a transient cell useful in the practice of the invention.

FIG. 4 shows a more detailed schematic of one structure for the transient cell 50 itself. The transient cell 50 comprises two polished aluminum plates 54, 56 embedded in plastic blocks 58, 60 for structural stabilization. An optional spring 62 is shown for physical stabilization of the system 50. Two filler gauge shims 64 are provided to maintain the equal spacing between the plates to provide a chamber 66 where liquid toner can be present. The transient cell is hooked up to a power source as shown in FIG. 1, the DC variable power source having a range of at least 0–250V, between 0–500V, between 0–1000V, and even higher, if desired, although 0–1000V is sufficient for the general practice of the invention.

The process can be performed in accordance with the following procedural steps. Liquid toner is placed between the plates, either by immersion, injected, or the like so that the entire gap is filled. In a preferred method, the liquid toner is introduced to the cell an extended area through the lower block of plastic 60 and is drawn into complete contact with the plates by surface tension of the liquid toner. This requires that the plates be relatively horizontal. For toner paste or concentrate that will not flow rapidly by surface tension forces, an excessive amount of toner paste or concentrate can be top loaded on the lower plate and the upper plate lowered to the gap spacing determined by the filler gauge shims, flattening out the paste to the predetermined separation distance between the plates. The switch is then activated, preferably using a fast response switch, to apply high voltage (greater than or equal to 100V or greater than or equal to 250V) between the plates. The voltage from the power source or the voltage across a resistor (current sensor 14) is measured and sent through digitizing circuitry to the computer. A software program (e.g., Microsoft Excel® software) can be used to separate the component of the signal contributed by particles only. This components of the signal relating to toner conductivity is then fit to another stylized computer software program (later described herein) to extract the toner conductivity and the associated charge density (ζ). The switch (10) is closed, applying greater than 99% of the power supply's voltage across the power cell. The resistor value (current sampling resistor) is chosen such that the voltage drop across the resistor is less than 1% of the total applied voltage. This forces a substantially constant voltage across the test cell. The current vs. time characteristic is then recorded by a data logging system connected to the current sampling resistor. The data logger is actually measuring the voltage across R. Since $I={}^{V}/_{R}$, the current may be derived. The charge to mass ratio (Q/m) is calculated (e.g., by the processor or computer) from ζ by assuming that the percent solids of the toner particles collected on the ground plate is the same as that collected on a development roller with a skive to squeeze out the excess liquid under a similar electroplating condition.

The following abbreviations are used in the examples:

EA: Ethyl Acrylate (available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

LMA: Lauryl methacrylate (available from Aldrich Chemical Co., Milwaukee, Wis.)

Norpar™ 12: A proprietary aliphatic hydrocarbon blend comprising mostly dodecane (available from Exxon Chemical Co., Baytown, Tex.).

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

Zirconium HEX-CEM: (metal soap, zirconium octoate, available from OMG Chemical Company, Cleveland, Ohio)

EXAMPLES

Figure 6:
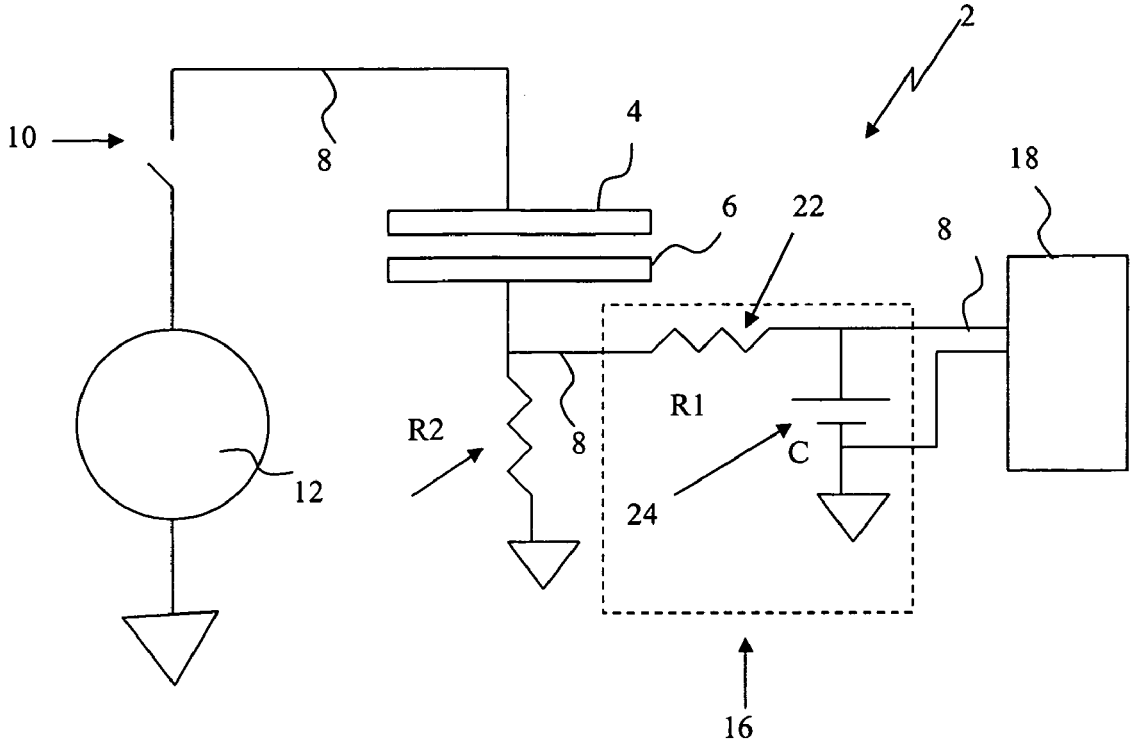
FIG. 6 shows a more detailed schematic of the electrical components of FIG. 4.

In the following examples and in the acquisition of the data, the current sensor is a simple resistor ($R_2$), and the filter is a low pass RC network with $R_1$ and C. $R_1$ and $R_2$ and C are chosen to be 10 KiloOhms, 210 KiloOhms and 1500 pF, respectively. FIG. 6, discloses a schematic drawing of our cell wherein $R_2$+210×$10^3$ ohms, $R_1$=10×$10^4$ ohms, C=1500×$10^{-12}$f, and the area within the dashed box is the low pass RC network (the filter). The filter (low pass RC network) included in the system is uncluded because the HP54542A Oscilloscope used by the inventors was bothered by very high frequency "noise." FIG. 6 is numbered like FIG. 1, where identical components are identically numbered. The dashed area 16 in FIG. 6 corresponds to element 16 in FIG. 3, but is shown in more detail in FIG. 6. The use of series resistor 22 ($R_1$), and a capacitor 24 were included to eliminate the very high frequency noise sensitivity that was inherent to the chosen digitizer (oscilloscope). Had the inventors chosen another model of oscilloscope/digitizer, the use of the filter may not have been necessary.

Example 1

An organosol having an effective core $T_g$ of 45° C. was prepared generally according to the method described in Comparative Example 16 of the referenced U.S. patent application Ser. No. 10/612535. The organosol, designated LMA/HEMA-TMI//EA-EMA-TCHMA (97/3-4.7//26-54-20% w/w), was prepared generally according to Comparative Examples 2 and 7 of the referenced U.S. patent application Ser. No. 10/612535, from a graft stabilizer comprising a copolymer of LMA and HEMA containing random side chains of TMI, covalently bonded through the vinyl group of the TMI to a thermoplastic copolymeric core comprising EA, EMA and TCHMA. The core/shell ratio was 8/1 w/w. The calculated glass transition temperature of the core is 35° C.

Six cyan liquid organosol toners were prepared from the 35° C. core $T_g$ organosol. For all toners, Pigment Blue 15:4 (Sun Chemical Co., Cincinnatti, Ohio) was used as the colorant, at a ratio of organosol solids to pigment solids of 8/1 w/w was used. Two of the toners are designated 5C because a charge director solution comprising 5 mg of 24% w/w Zirconium HEX-CEM in mineral spirits was added to two of the toners before milling, and milling was effected for 60 minutes and 90 minutes on the two respective 5C toners. Two of the toners are designated 10C because a charge director solution comprising 10 mg of 24% w/w Zirconium HEX-CEM in mineral spirits was added to two of the remaining toners before milling, and milling was effected for 60 minutes and 90 minutes on the two respective 10C toners. Two of the toners are designated 20C because a charge director solution comprising 20 mg of 24% w/w Zirconium HEX-CEM in mineral spirits was added to two of the remaining toners before milling, and milling was effected for 60 minutes and 90 minutes on the two respective 20C toners.

The experimental organosol and the six experimental cyan pigmented organosol toners derived therefrom were given the following identification codes:

| Ink | Ink I.D.** |
|---|---|
| 2220A | 2220A OO20-5C-OP8-60 MIN |
| 2220B | 2220B OO20-10C-OP8-60 MIN |
| 2220C | 2220C OO20-20C-OP8-60 MIN |
| 2224A | 2224A OO20-5C-OP8-90 MIN |
| 2224B | 2224B OO20-10C-OP8-90 MIN |
| 2224C | 2224C OO20-20C-OP8-90 MIN |

**Organosol OO20 LMA/EA-EMA-20% TCHMA in Norpar 12

OP 8 Organosol/pigment ratio = 8

5-20C CCA level(charge control agent) to the ink ratio in (mg/g), C refers to Cyan ink 60 MIN, 90 MIN The toner grinding time.

CCA Zirconium HEX-CEM solution (OMG Chemical Company, Cleveland, Ohio)

These inks are to be used in the apparatus and process testing. The conductivities (σ) are measured and then compared with those values obtained using a conventional conductivity meter (Model 627, SCIENTIFICA). The measured current through the resistor (R2) is treated as coming from two different mechanisms. One is considered to be fast moving toner migration under the field set up by the plates and the other current is considered to be coming from slower moving impurity ions in the toner. The measured current across the sensor R2 versus time can be expressed as the sum of $i_1$ and $i_2$ The toner particle current $i_1$ can be easily expressed as:

$$q=af(t)$$

$$i_1=af'(t)$$

$$a^2=2\epsilon\zeta A^2V_0$$

$$\tau=(R+R_2)(2\epsilon\zeta A^2)$$

$$f(t)=(e^{2at/\tau}-1)/(e^{2at/\tau}+1)$$

$$f'(t)=(a/\tau)(1-f^2(t))$$

R is related to toner particle σ by R=d/σA, where d is the separation of the two metal plates of the transient cell (TC) and A is the area of the plate. $R_2$ is the current sensing resistor value and t is the time of plating. ζ is the toner charge density and is related to Q/M (charge/mass) of the toner by the following relation; Q/M=ζ/ρα, where ρ is the toner paste density and α is the ink paste concentration. The current contributed by impurities and free phase fluid is assumed to be represented by;

$$i_2=i_0\exp(-t/\rho_2)$$

The total current, $i=i_1+i_2$. Its value verse time is determined mainly by the four parameters, $i_0$, $\tau_2$, $\sigma$ and $\zeta$ or Q/M. In these formulae,

| Formula affected | Symbol or letter | Meaning |
|---|---|---|
| $q = af(t)$ | q | Total toner charge accumulated on plate 6 at time t |
| | a | Square root of formula $a^2 = 2\epsilon\zeta A^2 V_0$ defined below |
| | f(t) | Function of time |
| $i_1 = af'(t)$ | $i_1$ | Toner particle current |
| | a | Square root of formula $a^2 = 2\epsilon\zeta A^2 V_0$ defined below |
| | f' | Derivative of f, above |
| | t | Time |
| $a^2 = 2\epsilon\zeta A^2 V_0$ | $a^2$ | A parameter defined by solving the formula |
| | $2\epsilon$ | Two times the dielectric constant of the toner ink/paste |
| | $\zeta$ | Toner charge density |
| | $A^2$ | The area of the plate, squared |
| | $V_0$ | Applied voltage |
| $\tau = (R + R_2)(2\epsilon\ \zeta A^2)$ | $\tau$ | A parameter defined by solving the formula |
| | R | Derived from $R = d/\sigma A$, defined below |
| | $R_2$ | Resistance of resistor $R_2$, as seen in FIG. 6 |
| | $2\epsilon$ | Two times the dielectric constant of the toner |
| | $\zeta$ | Toner charge density |
| | $A^2$ | The area of the plate, squared |
| $R = d/\sigma A$ | R | A parameter defined by solving the formula |

-continued

| Formula affected | Symbol or letter | Meaning |
|---|---|---|
| | d | Separation between plates/distance |
| | $\sigma$ | Conductivity of the ink/paste |
| | A | Area of the plate |
| $f(t) = e^{2at/\tau} - 1)/(e^{2at/\tau} + 1)$ | f(t) | Determination of the function of time |
| | e | Exponential, a natural number |
| | $2at/\tau$ | Solve using symbols defined above |
| $f'(t) = a/\tau)(1 - f^2(t))$ | All terms defined above | |
| $i_2 = i_0\exp(-t/\tau_2)$ | $i_0$ | The initial impurity current |
| | $\tau_2$ | The impurity migration time constant |

The software program is to assume values of those four parameters through iteration to obtain the best fit of the thousands of measured current values versus time.

A series of 2220 cyan toners (based upon the description of toner composition provided above) was used for examples. The results are shown below for an applied voltage of 100V across the plates.

2220_Cyan liquid toners
d = 863.6 μm cell height
A = 1.25 in$^2$ = 8.0645 cm$^2$ cell area

| ID | CCA | $R_{TC}$ | $\zeta_{TC}$(μC/cm$^3$) | $(Q/M)_{TC}$ | $\tau_2$ | $i_0$ |
|---|---|---|---|---|---|---|
| 2220A | 5 | 1.7E+08 | 20.64 | 74.8 | 2 | 0.0175 |
| 2220B | 10 | 68000000 | 34.24 | 124.1 | 1.2 | 0.034 |
| 2220C | 20 | 52000000 | 77.87 | 282.2 | 0.63 | 0.14 |

After converting to a thickness of 10 μm and an area of 1 cm$^2$, the data become For d = 10 μm, A = 1 cm$^2$

| ID | CCA | $R_{TC}$($10^8$ Ω) | $\zeta_{TC}$(μC/cm$^3$) | $\sigma_{TC}$(pMho/cm) | $(Q/M)_{TC}$ | $(Q/M)_m$ | $a_o$(%) | Dv | $\sigma_m$ |
|---|---|---|---|---|---|---|---|---|---|
| 2220A | 5 | 0.159 | 20.64 | 63 | 75 | 124 | 11.59 | 1.4 | 109 |
| 2220B | 10 | 0.064 | 34.24 | 157 | 124 | 201 | 11.43 | 1.207 | 174 |
| 2220C | 20 | 0.049 | 77.87 | 206 | 282 | 328 | 11.39 | 1.399 | 253 |

In the preceding tables, quantities in columns designated with the "TC" (transient cell) subscript are measured through the method of this invention. Quantites in columns designated with the subscript "M" are measured using conventional techniques for comparison purposes. In the preceding tables, the following definitions apply.

| | |
|---|---|
| $a_0$ | is the toner ink concentration |
| $D_v$ | The volume average particle size of the toner in μm |

Figure 5A:
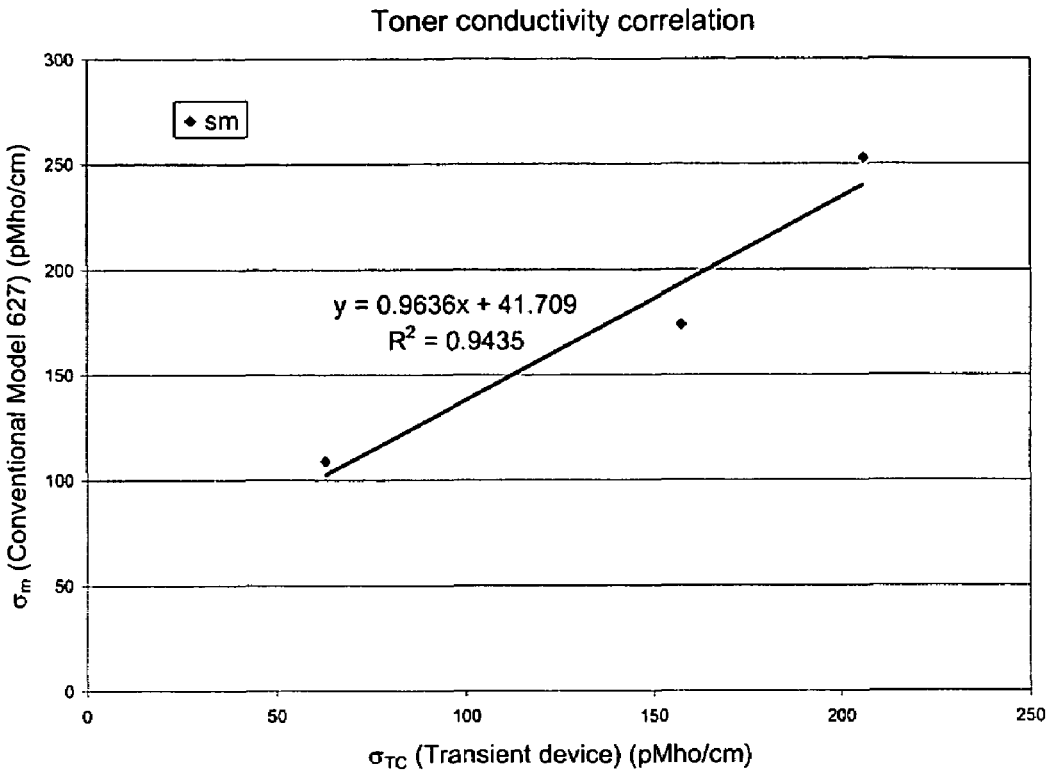
FIGS. 5*a* and 5*b* show graphs of linear resistance values determined from measurements according to the invention

$\sigma_{TC}$ and $\sigma_m$ are measured using our device and Model 627 meter respectively. The two conductivities correspond very nicely as shown in the following diagram. However, our measurement is real, for no contribution from free counter ions is taken into account. The power supply of the Model 627 operates at 110V at 60 Hz. This data is shown in the graph of FIG. 5*a*. CCA levels in the table above refer to the amount of charge control agent by weight to the toner weight in mg/g. For instance, 5 CCA is 5 mg of charge director to 1 g of ink weight.

ware program we are using right now is written in Microsoft Excel®, as an example of the type of commercially available software (or individually stylized software) that can be used in the practice of this invention. It is indeed merely an executable form of the equations shown in example 1, together with an estimation of the least square fitting error based on a standard function of Excel. Based on the equations of example 1, values for the parameters $i_0$, $I_2$, σ, and ζ are "guesstimated" and values of i for various time t are calculated. They are compared with the waveform i(t) of the measurement and the least square fit value $R^2$ is computed. A new set of $i_0$, $I_2$, σ, and ζ are then input again to obtain a new $R^2$ value and to compare with the old $R^2$. The set of $i_0$, $I_2$, σ, and ζ s that corresponds to higher $R^2$ values is used as the base for the next "guesstimating." This process is iterated until $R^2$ reaches a maximum value (the perfect fit has $R^2$=1). The values of $i_0$, $I_2$, σ, and ζ correspond to the final $R^2$ that will then be used to represent /calculate the conductivity and Q/M of the toner particles. For practicality, the iteration has to be built in the software program rather than hand input. The field effect on one of our experimental toner, 2224A with 5 CCA level is shown below.

2224A_Cyan toner

For d = 10 μm, A = 1 cm²

| $V_{Applied}$ (V) | $R_{TC}$($10^8$ Ω) | $\zeta_{TC}$(μC/cm³) | σ(pMho/cm) | $(Q/M)_{TC}$ | $\sigma_m$(pMho/cm) | $(Q/M)_m$ |
|---|---|---|---|---|---|---|
| 100 | 1.541 | 1.78 | 6 | 6 | | |
| 200 | 1.065 | 1.69 | 9 | 6 | | |
| 300 | 0.448 | 7.51 | 22 | 27 | 36.00 | 34.00 |
| 400 | 0.327 | 12.20 | 31 | 44 | | |

**The measurements made using the prior art method (e.g. $(Q/M)_m$) were done only at an applied voltage of 300 V. The other values for the prior art measurement are assumed to be the same.

Figure 5B:
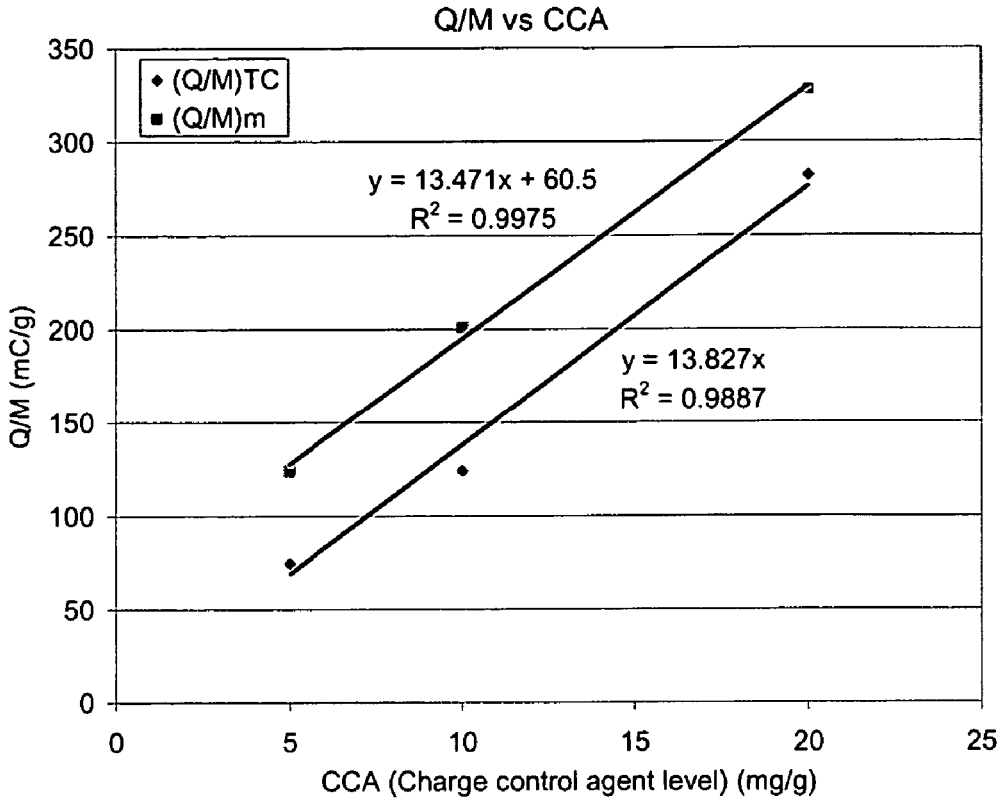

The (Q/M)s measured using our technique tend to be more accurately reflecting the actual value than other methods. The correlation between the two measurements is very good. The plot of the two measurements is shown below. The units of Q/M is μC/g. The constant term in the (Q/M)s plot indicates the contribution from the impurity. This data is shown in the graph of FIG. 5*b*. The $(Q/M)_m$ is the charge per mass of the ink/paste measured by a conventional technique that measures the total charge Q (area A in FIG. 1) in an arrangement similar to that shown in FIG. 1. The toner bearing carrier 8 is removed and dried in an oven to obtain the toner mass. $(Q/M)_m$ is obtained by dividing Q by M. The units of Q/M is μC/g (microColumbs per gram).

Example 2

That the conductivity of the liquid toner will change with the field of measurement is well known and yet not fully documented. Most of the conventional measurements using AC field, the effect of the field is masked by the counter-ion contribution. In the actual practice of the invention, a pulsed DC current has been used. This provides a single transient response, in which current versus time is measured. Our device and analysis software allow us to study such an effect and use it in their toner development evaluation. The soft-

Example 3

In studying the liquid toner paste transfers, namely, the transfer of toner paste developed on a development roll (Dev-roll) to an OPC or from an OPC to an intermediate transfer belt (ITB) or from an ITB to a paper, the value of the toner paste conductivity is needed in order to optimize the components involved to favor image transfer. This value can only be obtained using our device and the associated software program. The toner pastes for this example is removed by scraping the toner pastes directly deposited on a Dev-roll under the electrophotographic conditions. The results are displayed below.

2224_Cyan toner liquid and paste

| Toner ID | CCA | $\sigma_{Paste}$ | $\sigma_{TC}$ | $\sigma_m$ | $(Q/M)_{Paste}$ | $(Q/M)_{TC}$ | $(Q/M)_m$ |
|---|---|---|---|---|---|---|---|
| 2224A | 5 | 17 | 22 | 36 | 63 | 27 | 34 |
| 2224B | 10 | 40 | 110 | 170 | 107 | 328 | 126 |
| 2224C | 20 | 119 | 243 | 293 | 280 | 1049 | 233 |

The $\sigma_{TC}$ and $\sigma_m$ are values obtained from liquid toners using our transient cell (TC) and the conventional Model 627 conductivity meter respectively. The units of σ and Q/M are pMho/cm and μC/g respectively. It is seen that another advantage of the new technique allows measurements on toners of various % solids. For instance the % solid of the liquid toner is ~10–18% and the % solids of the toner paste is from 20–40%.

Although specific materials, specific apparatus and specific process parameters are provided above, those parameters and the values selected are merely exemplary and unless otherwise stated are not to be limiting in considering the scope or definition of terms or of the invention itself. Alternatives and equivalents should be readily understood by those skilled in the art.

What is claimed is:

1. An apparatus for measuring conductivity of a liquid or paste toner comprising:

two parallel conductive plates (4, 6), an electrical switch (10) between the plates, a power supply (12) between the electrical switch(10) and one of the two conductive plates, a current sensor for measuring data relating to current (14), filter (16), a digitizer (18), data storage and processor (20) having analytic capability for adjusting the data relating to current to remove contributions to data attributable to impurity ions.

2. The apparatus of claim 1 wherein a data digitizer (18) is present between the sensor and the data storage and processor having analytic capability (20).

3. The apparatus of claim 1 wherein the switch is a high speed switch.

4. The apparatus of claim 1 wherein the switch is a bounceless switch.

5. A method for measuring conductivity (σ) of a liquid or paste electrophotographic toner comprising:

providing two parallel plane conductive plates with a uniform separation (d) between the plates to form a space between the plates;

filling the space between the plates with liquid or paste electrophotographic toner;

applying a voltage of at least 1V between the plates across the liquid or paste toner;

measuring as data current vs. time passing through the plates;

digitizing the data;

sending digitizing data to a processor; and determining the conductivity from the digitized data.

wherein determining conductivity and charge per mass from the digitized data includes determining toner particle current according to the relationships;

$$i=i_1+i_2$$

where $$i_1=af'(t)$$

and $$i_2=i_0\exp(-t/\tau_2)$$

$$Q=af(t)$$

$$I_1=af'(t)$$

$$A^2=2\epsilon\zeta A^2V_0$$

$$\tau=(R+R_2)(2\epsilon\zeta A^2)$$

$$F(t)=(e^{2at/\tau}-1)/(e^{2at/\rho}+1)$$

$$F'(t)=(a/\tau)(1-f^2(t))$$

$$R=d/\sigma A,$$

$$i_2=i_0\exp(-t/\tau_2)$$

and $$i_2=i_0\exp(-/\tau_2)$$

$$Q=af(t)$$

$$I_1=af'(t)$$

$$A^2=2\epsilon\zeta A^2V_0$$

$$\tau=(R+R_2)(2\epsilon\zeta A^2)$$

$$F(t)=(e^{2at/\tau}-1)/(e^{2at/\rho}+1)$$

$$F'(t)=(a/\tau)(1-f^2(t))$$

$$R=d/\sigma A,$$

$$i_2=i_0\exp(-t/\tau_2)$$

Q/M (charge per mass)=ζ/ρα, where ρ is toner paste density and α is paste concentration;

| Wherein the terms in the Formulae affected are defined as | Symbol or letter | Meaning |
|---|---|---|
| Q = af(t) | q | Total toner charge accumulated on plate 6 at time t |
| | a | Square root of formula $a^2 = 2\epsilon\zeta A^2V_0$ defined below |
| | f(t) | Function of time |
| $i_1 = af'(t)$ | $i_1$ | Toner particle current |
| | a | Square root of formula $a^2 = 2\epsilon\zeta A^2V_0$ |
| | f' | Derivative of f, above |
| | t | Time |
| $A^2 = 2\epsilon\zeta A^2V_0$ | $a^2$ | A parameter defined by solving the adjacent formula |
| | 2ϵ | Two times the dielectric constant of the toner ink/paste |
| | ζ | Toner charge density |
| | $A^2$ | The area of the plate, squared |
| | $V_0$ | Applied voltage |
| $\tau = (R + R_2)(2\epsilon\ \zeta A^2)$ | τ | A parameter defined by solving the formula |
| | R | Derived from R = d/σA, defined below |
| | $R_2$ | Resistance of resistor $R_2$, |
| | 2ϵ | Two times the dielectric constant of the toner |
| | ζ | Toner charge density |
| | $A^2$ | The area of the plate, squared |
| R = d/Σa | R | A parameter defined by solving the adjacent formula |
| | d | Separation between plates/distance |
| | σ | Conductivity of the ink/paste |
| | A | Area of the plate |

-continued

| Wherein the terms in the Formulae affected are defined as | Symbol or letter | Meaning |
|---|---|---|
| $f(t) = (e^{2at/\tau} - 1)/(e^{2at/\tau} + 1)$ | f(t) | Definition of the function of time |
| | e | Natural logarithm |
| | $2at/\tau$ | Solve using symbols defined above |
| $f'(t) = (a/\tau)(1 - f^2(t))$ | As defined above | |
| $i_2 = i_0 \exp(-t/\tau_2)$ | $i_0$ | The initial impurity current |
| | $\tau_2$ | The impurity migration time constant. |

6. The method of claim 5 wherein the voltage is between 50V and 1000V.

7. The method of claim 6 including calculating charge to mass ratio of the toner (Q/m, wherein Q is charge and m is mass) from ζ by assuming that percent solids of toner particles collected on a ground ground plate is the same as that collected on a development roller under a similar electroplating condition, wherein ζ is associated charge density.

8. The method of claim 5 including calculating charge to mass ratio of the toner (Q/m) wherein Q is charge and m is mass from ζ by assuming that percent solids of toner particles collected on a ground plate is the same as that collected on a development roller under a similar electroplating condition, wherein ζ is associated charge density.

9. The method of claim 5 including calculating the charge to mass ratio of the toner (Q/m) from ζ by assuming that percent solids of toner particles collected on a ground plate is the same as that collected on a development roller under a similar electroplating condition, wherein ζ is associated charge density.

10. A method for measuring conductivity (σ) of a liquid or paste electrophotographic toner comprising:

providing two parallel plane conductive plates with a uniform separation (d) between the plates to form a space between the plates;

filling the space between the plates with liquid or paste electrophotographic toner;

applying a current voltage of at least 1V between the plates across the liquid or paste toner;

measuring as data the current passing through an external component into the plates;

adjusting the data to remove current contributions attributable to impurity ions;

sending adjusted data to a processor; and determining the conductivity from the adjusted data.

11. The method of claim 10 wherein the voltage is between 1V and 1000V.

12. The method of claim 11 including calculating charge to mass ratio of the toner (Q/m) from ζ by assuming that percent solids of toner particles collected on a ground plate is the same as that collected on a development roller under a similar electroplating condition, wherein ζ is associated charge density.

13. The method of claim 10 including calculating charge to mass ratio of the toner (Q/m, wherein Q is charge and m is mass) from ζ by assuming that percent solids of toner particles collected on a ground ground plate is the same as that collected on a development roller under a similar electroplating condition, wherein ζ is associated charge density.

14. The method of claim 10 wherein the voltage is between 50V and 1000V.

15. The method of claim 10 wherein the voltage is between 100V and 1000V.

* * * * *